United States Patent [19]

DiLaurenzio

[11] 4,006,895

[45] Feb. 8, 1977

[54] REVOLVING EXERCISING DEVICE

[76] Inventor: Anthony DiLaurenzio, 4832 Merten Ave., Cypress, Calif. 90630

[22] Filed: June 2, 1975

[21] Appl. No.: 582,588

[52] U.S. Cl. ..... 272/67; 74/551.9

[51] Int. Cl.[2] ..... A63B 23/00

[58] Field of Search ..... 272/67, 68, 79 R, 79 B, 272/79 D, 128, 129, 130, 131, 132; 273/58 K; 74/551.9

[56] References Cited

UNITED STATES PATENTS

| | | | |
|---|---|---|---|
| 604,216 | 5/1898 | Raczek | 74/551.9 |
| 684,117 | 10/1901 | Sloan, Jr. | 272/68 |
| 1,638,196 | 8/1927 | Guth | 272/68 |
| 2,718,644 | 9/1955 | Barr | 273/58 K X |
| 3,033,565 | 5/1962 | Wolski | 272/58 |
| 3,269,727 | 8/1966 | Samuel | 272/79 R |

FOREIGN PATENTS OR APPLICATIONS

| | | | |
|---|---|---|---|
| 1,253,188 | 12/1960 | France | 272/79 B |

*Primary Examiner*—Richard T. Stouffer
*Attorney, Agent, or Firm*—Stuart W. Knight

[57] ABSTRACT

A revolving wrist exercising device is provided which comprises in combination a round member to which is attached two grip handles each of which is attached to the member by a threaded bar. The two grip handles are each freely rotatably attached to their respective bar at generally 90° with respect to each other. A person utilizes the device by gripping the handles and rotating the round member by using wrist action.

1 Claim, 2 Drawing Figures

REVOLVING EXERCISING DEVICE

This invention relates to a simple exercising device designed to exercise the wrist, forearm and in some cases, the shoulder.

Another object of the invention is to provide an exercising device to strengthen the muscles of the forearm and the "wrist."

Other objects of the invention will appear from the following description.

The invention comprises, in combination, a ball, two bars imbedded into such ball at an angle of generally 90°, to each other, a stock surrounding the axis of each bar, an outer handle surrounding each stock, and the ball, bars, stock and handle in communication with each other and combined with each other so that the user can grip the handles and rotate the ball clockwise or counter clockwise by wrist action. The wrists of the user are substantially stable and the forearm is stationary with the hands and part of the wrists being rotated to rotate the ball and give exercise.

The handles which surround the stock can be rotated by the user. The forearm of the user is stationary; however, by rotating the user's wrists, with the handles surrounding the stock rotating about the axis of the stock, the user can rotate the ball as shown in the accompanying drawing.

Figure 1:
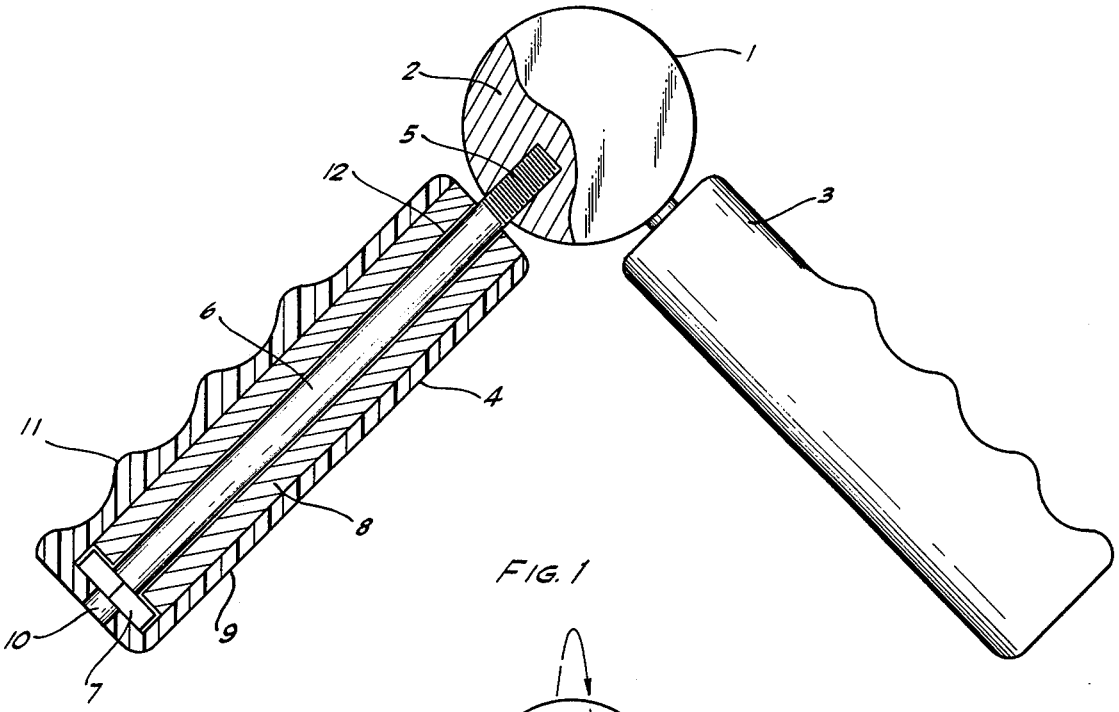
FIG. 1 is a side elevation view of the invention.

Referring to FIG. 1, ball 1 is shown as being solid. Such "ball" is preferred to be spherical, however, it is obvious that other similar shapes can be utilized in the invention. It is also apparent that the ball can be hollow in part; however, a solid ball is preferred. The ball can be made of any material such as metal, plastic, wood or the like. A plastic ball is preferred for ease of manufacturing and handling. A bar 6 is shown imbedded into ball 1 by means of threads 5. Thus, the two bars can be connected into ball 1 by threads attached to the bar and female threads in the ball. Other means can be utilized to imbed the bar 6 into ball 1; however, threads are preferred. Bar 6 can be composed of any construction material; however, a standard metal stock is preferred. As shown, the bar has a bolt at its end shown as 7.

A standard stock 8 surrounds the bar 6. Such stock can be made of any construction material; however, a solid metal is preferred. As shown in FIG. 1, there is a space between the standard stock and the bar 6 such that the stock can rotate about its own axis. Thus the bar can be imbedded in the ball 1 with the standard stock rotating about the axis of the bar. Handle 11 is shown attached to stock 8 forming one essential piece. The handle 3 is standard in the art and handles such as a bike handle can be utilized. Standard stock 8 can be manufactured simply by drilling a hole through any solid piece. The handles are each attached to the stock and bar such that there is a space between the handle and the bar. The handles can thus freely rotate about the axis of the bar. The user can thus rotate the ball and the rotating movement of the handles facilitates such movement.

Figure 2:
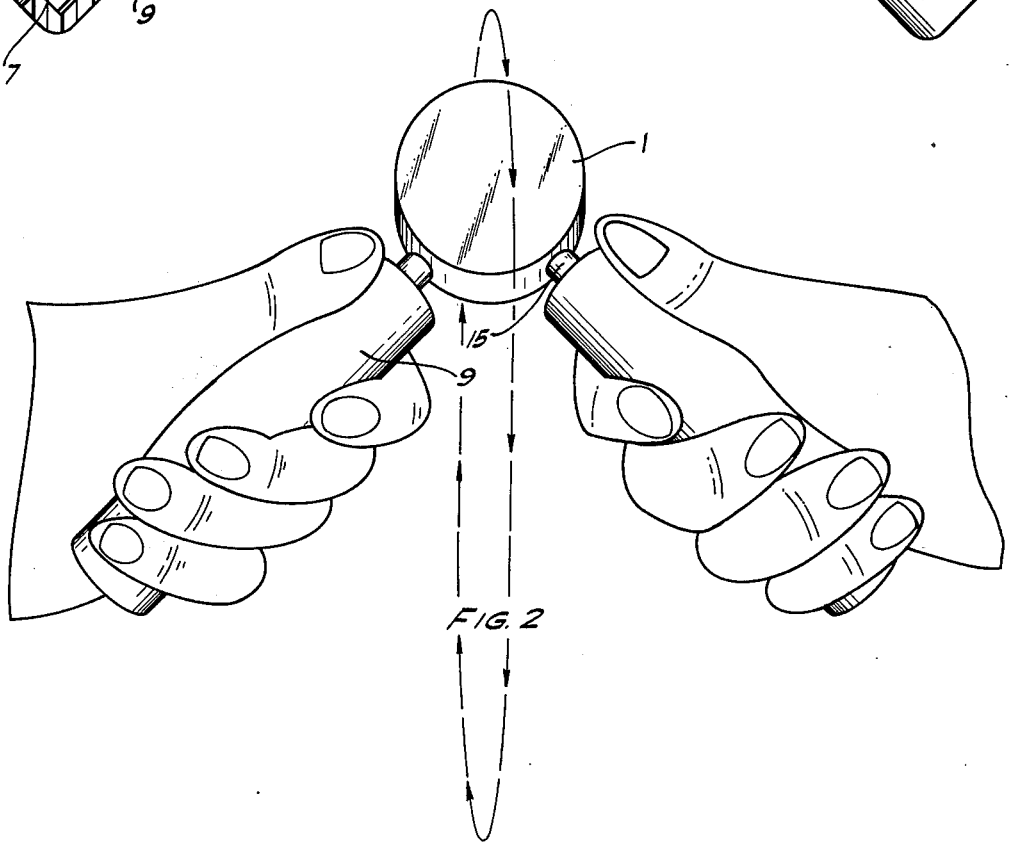
FIG. 2 is an illustrative view of the invention.

FIG. 2 shows the user rotating the ball 1 by a simple rotation of the user's wrists. The forearm and arm in general of the user is substantially stationary and stable. The wrists obviously move and by rotation of the wrists, the ball rotates. Thus, the user obtains exercise not only for his wrists but forearm and arm in general. Back muscles are also exercised.

I claim:

1. A wrist exercising device comprising, in combination, a solid member, two bars imbedded into said member at an angle of generally 90° to each other, a stock freely rotatably mounted on and surrounding the axis of each bar, an outer handle surrounding each stock, said member, bars, stock and handles in communication with each other and combined with each other so that when the two handles are grasped by the user, the user can rotate said member by wrist action.

* * * * *